United States Patent [19]

Reich

[11] 3,949,882

[45] Apr. 13, 1976

[54] ROTARY TOWER CRANE

[75] Inventor: Elmar Reich, Biberach an der Riss, Germany

[73] Assignee: Hans Liebherr, Biberach, Germany

[22] Filed: Jan. 7, 1975

[21] Appl. No.: 539,086

Related U.S. Application Data

[63] Continuation of Ser. No. 369,972, June 14, 1973, abandoned.

[30] Foreign Application Priority Data

June 15, 1972 Germany ..... 2229317

[52] U.S. Cl. ..... 212/144

[51] Int. Cl.[2] ..... B66C 23/62

[58] Field of Search ..... 212/46, 28, 70, 144; 52/637, 648, 649

[56] References Cited

UNITED STATES PATENTS

| | | | |
|---|---|---|---|
| 1,532,151 | 4/1925 | Ostrander | 212/144 |
| 3,037,588 | 6/1962 | Causey | 52/637 |
| 3,249,238 | 5/1966 | Hedeen | 212/144 |
| 3,407,559 | 10/1968 | Durand | 52/637 |

*Primary Examiner*—Robert B. Reeves
*Assistant Examiner*—Francis J. Bartuska
*Attorney, Agent, or Firm*—Edward R. Weingram

[57] ABSTRACT

A rotary tower crane has a tower constructed from uniformly sized sections which can be arranged to provide a tower of small or large cross section, as required. The tower sections can be aligned in a single, vertical column to provide a tower having a narrow cross section, or a plurality of sections can be joined horizontally to form sections of enlarged cross section, which are then vertically aligned to provide a tower having an enlarged cross section.

9 Claims, 3 Drawing Figures

5
6
3
4
7
1
8
2

ROTARY TOWER CRANE

This is a continuation, of application Ser. No. 369,972 filed June 14, 1973 now abandoned.

BACKGROUND OF THE INVENTION

1. Field of the Invention

The present invention relates to construction equipment and, more particularly, to a rotary tower crane having a tower consisting of a plurality of coaxial sections detachably connected to each other.

2. Description of the Prior Art

There are two main types of rotary tower cranes. One type has a needle-type boom of variable inclination. The other, and more common, type has a horizontal boom with a crab movably mounted on the boom to move in the lengthwise direction of the boom. The tower of either type of crane can be mounted on an undercarriage adapted to travel on rails, or else is mounted in fixed position on a base. The boom is pivotable with respect to the tower, either being pivotally mounted to the head of the tower and/or the tower head being rotatably supported about the longitudinal axis of the tower.

If rotary tower cranes are constructed with a freestanding tower, i.e., without external lateral support for the tower, the maximum height of the tower will depend upon the size of the cross section of the tower. The longer the freestanding tower is to be, the larger the cross section of the tower must be, to provide stability and strength to the structure. For example, the cross-sectional dimensions of the tower for tower heights above 30 meters are no longer determined by the lifting capacity of the rotary tower crane, but instead are determined by the stability required to withstand lateral wind pressure.

To obtain maximum benefit of a tower crane, it is desirable to have the tower crane as close to the work area as possible. Consequently, it is desirable that the tower of the crane have the smallest possible cross section, namely, the cross section sufficient only to handle the desired lifting capacity of the rotary tower crane. However, in order to assure stability of such a narrow tower crane against lateral wind pressure, it is necessary to anchor the narrow tower to the building alongside which the rotary tower crane has been placed for operation, at one or more places along the length of the tower.

Anchoring the tower to the building is disadvantageous, however, because the anchoring devices required, as well as their installation between the rotary tower crane and the building, are relatively costly. Therefore, it is considered preferable to make the towers freestanding, where practicable, in order to avoid having to use the anchoring procedures described above. Accordingly, relatively high towers have to be built from heavier sections having larger cross sections, while the towers of rotary tower cranes used only for small tower heights used tower sections of smaller cross section.

In view of the above, it becomes clear that at least two sets of tower sections of different cross-sectional size must be available and kept in stock. Even if this may not be necessary at the specific building site or the specific place of use of the rotary tower crane, nevertheless, such a supply of tower sections of different cross-sectional size must be kept available at a central storage place.

SUMMARY OF THE INVENTION

In order to overcome the problem of using different sized sections to construct crane towers having different cross sections, depending upon the height of the freestanding tower, the present invention sets forth a rotary tower crane whose tower is constructed from uniformly sized sections which can be arranged to provide a tower of small or large cross section, as required. The tower sections can be aligned in a single, vertical column to provide a tower having a narrow cross section, or a plurality of sections can be joined horizontally to form sections of enlarged cross section, which are then vertically aligned to provide a tower having an enlarged cross section.

In one embodiment of the invention, four rectangular framework sections are attached at their adjacent vertical edges to form a section of enlarged cross section, having a rectangular central opening for receiving the tower head of the crane, which opening is approximately equal in size to the cross section of the original smaller sections. In another embodiment of the invention, three rectangular framework sections are attached at their adjacent vertical edges to form a section of enlarged cross section having a triangularly shaped central opening. In yet another embodiment of the invention, enlarged tower sections formed from rectangular sections and having a triangular central opening are vertically arranged to form the bottom portion of a tower, the upper portion of which tower consists of vertically aligned triangular sections.

Tower heads for the crane of square or triangular cross section are used, which are compatible with the shape of the central opening of the tower section in use at the upper end of the tower.

Accordingly, in view of the above, it is an object of the present invention to provide a rotary tower crane having a tower which can be constructed in different cross-sectional sizes and configurations, using identically sized tower sections.

Another object of the present invention is to provide a rotary tower crane which does not require sections of different size in order to produce towers of different height and/or cross-sectional dimension.

It is a further object of the present invention to provide a rotary tower crane which does not require the storage of large quantities of dissimilar structural members for selective use in constructing towers of different length or cross-sectional dimension.

Yet another object of the present invention is to provide a rotary tower crane which is constructed of detachable sections which can be easily altered and rearranged to modify the dimensions and/or strength of the tower.

Other objects and advantages will be apparent from the following description of several embodiments of the invention, and the novel features will be particularly pointed out hereinafter in connection with the appended claims.

DESCRIPTION OF THE PREFERRED EMBODIMENTS

Figure 1:
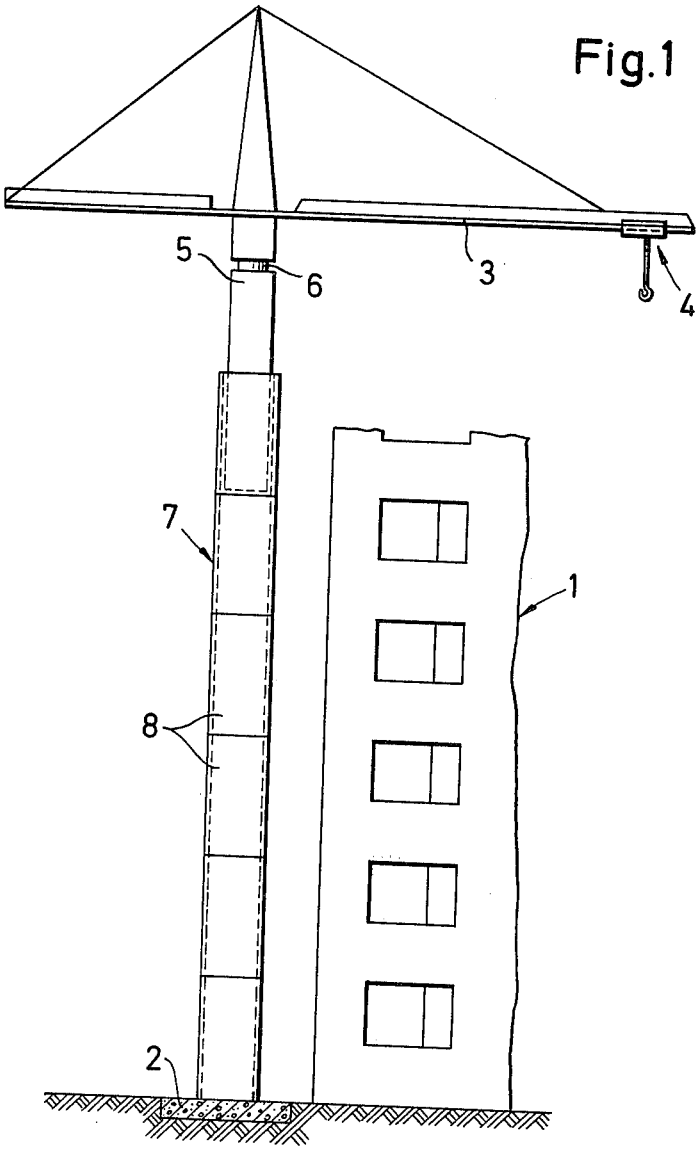
FIG. 1 is a side view of a rotary tower crane built in accordance with the teachings of the present invention.

Referring to FIG. 1, a freestanding rotary tower crane is constructed in fixed position on a base 2 alongside a building 1. The rotary tower crane has a horizontal boom 3 with a crab 4 movable thereon in the longitudinal direction of the boom. The boom is pivoted to the tower head 5 above a rotatable collar or slewing ring 6.

The tower head 5 is inserted into the tower 7 and can be telescoped down into the tower. The tower 7 consists of a plurality of coaxial, vertically aligned, rectangular sections 8, which are detachably connected to each other by any convenient fastening means (not shown), such as bolting along adjacent ends. The tower sections 8 have open vertical ends to allow for mounting of the tower head. These sections are usually framework structures made from common structural components, such as I-beams, etc., and, when assembled, form a latticework-type of tower.

Figure 2:
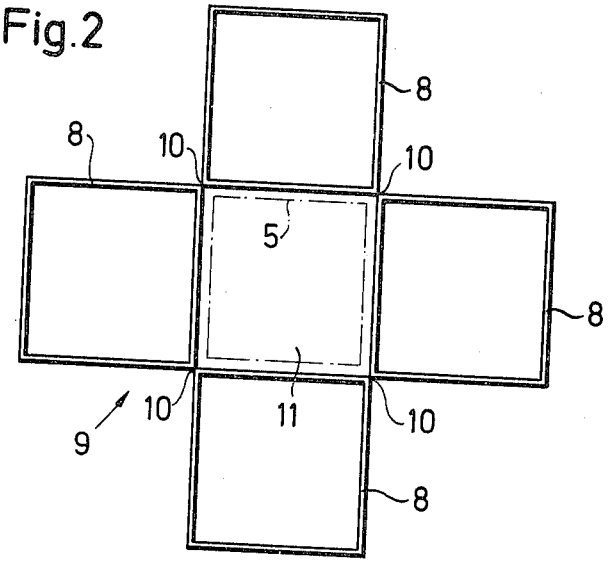
FIG. 2 is a cross section through an enlarged tower section consisting of four sections of smaller cross section which are detachably connected to each other at their edges.
Figure 3:
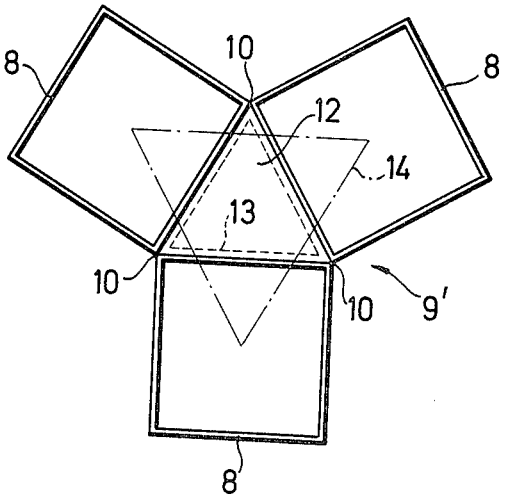
FIG. 3 is a cross section through an enlarged tower section consisting of three sections of smaller cross section which are detachably connected to each other at their edges.

When the freestanding height of the tower becomes so high that the cross-sectional dimensions of the tower must be increased to provide greater strength and stability, then the sections of the tower will be composed of several of the smaller rectangular sections 8 fastened together to form sections of enlarged cross section, as shown in FIGS. 2 and 3.

For purposes of simplicity and clarity, the same items appearing in more than one figure will be designated by the same number.

As shown in FIG. 2, a section of enlarged cross section, generally indicated as 9, consists of four rectangular sections 8 which are detachably connected at their adjacent vertical edges 10 by any convenient fastening means (not shown), such as bolting. The small sections 8 form a cross-shaped pattern with a rectangular central opening 11 about equal in size to the openings of the individual sections 8, and, therefore, suited to receive the tower head of the crane 5, shown in dashed lines.

FIG. 3 shows another embodiment of tower sections of enlarged cross section, generally indicated as 9', which consists of three rectangular sections 8 detachably connected at their adjacent vertical edges 10 by any convenient fastening means (not shown) such as bolting. The smaller sections 8 form a Y-shaped pattern with a triangular central opening 12 adapted to receive a triangular tower head 13 for the crane, shown in dashed lines.

By using the components described herein to construct the crane tower, it is apparent that great flexibility is afforded for the size and shapes in which the tower can be constructed. It is even possible to construct towers having different cross section sizes and shapes along the length of the tower so, for example, as shown in FIG. 3, it would be possible to have a tower formed with enlarged Y-shaped tower sections 9' positioned at the lower portion of the tower, while the upper portion of the tower could be formed from sections of triangular cross section 14, shown in dotted lines, which would be smaller than enlarged sections 9' and would rest upon the lower portion of the tower made from sections 9'. The same triangular-type head 13 could be fitted within the triangular tower section 14.

It should also be pointed out that although the embodiments of the invention shown in FIGS. 2 and 3 show square sections used to form enlarged sections 9 and 9', the smaller sections 8 need not be square, or even rectangular, in cross-sectional shape, but could be triangular in cross-sectional shape, or could have cross-sectional shapes of other common geometrical forms, and still function within the scope of the invention.

It will be understood that various changes in the details, materials and arrangements of parts which have been herein described and illustrated in order to explain the nature of the invention may be made by those skilled in the art within the principle and scope of the invention, as expressed in the appended claims.

What is claimed is:

1. A rotary tower crane having a tower head and a tower formed from vertically aligned tower sections at least one of said tower sections having an enlarged cross section, said enlarged tower section comprising:

a plurality of uniformly shaped geometric structures;

each of said geometric structures comprising a plurality of rectangular faces enclosing open vertical ends, each of said geometric structures constructed and arranged to serve as an individual tower section for a rotary tower crane;

each of said geometric structures having a plurality of vertical longitudinal edges of equal length;

each of said geometric structures disposed in a common horizontal plane so that two of said vertical longitudinal edges of each geometric structure are disposed adjacent said vertical longitudinal edges of adjacent geometric structures along the length of said longitudinal edges; and means connecting said adjacent vertical longitudinal edges to hold said geometric structures in disposition so that said structures form an enclosed central opening adapted to receive said tower head said opening having sides substantially equal in length to the horizontal length of said faces of said geometric structures.

2. The rotary tower crane according to claim 1 wherein said enlarged tower section comprises:

four uniformly shaped geometric structures; and said uniform geometric structures form an enclosed central opening of rectangular cross section.

3. The rotary tower crane according to claim 1 wherein said enlarged tower section comprises three uniformly shaped geometric structures which form a central opening of triangular cross section.

4. The rotary tower crane according to claim 1 wherein said uniformly shaped geometric structures are rectangular in cross section.

5. The rotary tower crane according to claim 1 wherein said uniformly shaped geometric shaped structures are triangular shaped in cross section.

6. The rotary tower crane according to claim 1 wherein above said enlarged tower section said crane tower includes at least one of said geometric structures constructed and arranged to serve as an individual tower section connected to said tower head.

7. The rotary tower crane according to claim 1 wherein:

said tower head has a triangular cross sectional configuration; and said enlarged tower section comprises a plurality of said geometric structures disposed to form an enclosed central opening of triangular configuration in the horizontal plane adapted to receive said triangular tower head.

8. The rotary tower crane according to claim 6 wherein said tower head is of rectangular cross-sectional configuration.

9. The rotary tower crane according to claim 7 wherein above said enlarged tower section is disposed at least one tower section of triangular cross-sectional configuration.

* * * * *